US006350185B1

(12) United States Patent
Robins et al.

(10) Patent No.: US 6,350,185 B1
(45) Date of Patent: Feb. 26, 2002

(54) GRIT BLAST NOZZLE FOR SURFACE PREPARATION OF TUBE

(75) Inventors: Brian Gregory Robins, Tracy; Pierre Duden, San Jose, both of CA (US)

(73) Assignee: Space Systems/Loral, INc., Palo Alto, CA (US)

( * ) Notice: Subject to any disclaimer, the term of this patent is extended or adjusted under 35 U.S.C. 154(b) by 0 days.

(21) Appl. No.: 09/501,166

(22) Filed: Feb. 9, 2000

(51) Int. Cl.[7] ..... B24B 3/32

(52) U.S. Cl. ..... 451/76; 451/38; 451/102; 15/95

(58) Field of Search ..... 451/38, 99, 76, 451/102, 381, 39–40, 37; 239/518, 520, 521; 15/95, 3.5

(56) References Cited

U.S. PATENT DOCUMENTS 1,045,742 A * 11/1912 Pontani ..... 451/76
1,952,848 A * 3/1934 Eckler ..... 451/76
2,089,597 A * 8/1937 Carter ..... 451/102
2,739,424 A * 3/1956 Fritze ..... 451/76
3,485,671 A * 12/1969 Stephens ..... 451/76
3,982,605 A * 9/1976 Sneckenberger ..... 451/102
4,545,317 A * 10/1985 Richter et al. ..... 451/102
4,663,893 A * 5/1987 Savanick et al. ..... 451/102

FOREIGN PATENT DOCUMENTS

DE 88-220609-32 * 10/1981 ..... 451/102

* cited by examiner

*Primary Examiner*—George Nguyen
(74) *Attorney, Agent, or Firm*—Perman & Green, LLP

(57) ABSTRACT

The invention resides in a method and apparatus for conditioning an inner surface of a tube. A pressurized mixture of air and grit and is supplied to a nozzle having an opening with a given diameter through which diameter the pressurized grit and air pass. An elongated nozzle adapter is connected to said nozzle. The nozzle adapter has a passage having a diameter substantially equal to the diameter of said nozzle and said nozzle adapter is connected to said nozzle such that the opening in said nozzle and said passage are aligned with one another. The nozzle adapter is inserted into a tube and is axially moved and rotated in order to condition the inner surface thereof with a pressurized mixture of air and grit.

17 Claims, 3 Drawing Sheets

GRIT BLAST NOZZLE FOR SURFACE PREPARATION OF TUBE

TECHNICAL FIELD

The present invention relates to an improvement in waveguide formation and relates more particularly to an improved method of conditioning a surface on a part made of a composite material, in preparation for subsequent bonding or metal coating applications.

High power multicarrier microwave space antenna waveguides are important to the communication capability of satellites. Conventional waveguides are hollow tubes made preferably from a graphite composite and are subsequently coated with a metal to effect electrical conductivity. Usually the metal coating used is copper or silver. The effect of creating a waveguide in a satellite with a composite structure coated with metal is to reduce the mass of the satellite payload by replacing waveguides normally made entirely of metal. In launching a satellite into space, weight of satellite components at lift off into orbit can cost thousands of dollars per pound to launch. Therefore, lightweight yet highly effective component parts of each satellite are mandatory and are an integral part of satellite construction.

As illustrated in FIG. 1, a prior art grit blast nozzle 1 is shown. Such a nozzle is commercially available and can be used to condition the inner surface of hollow tubes. However, this nozzle is adapted for use in a direct pressure grit blast system, which unfortunately is not always available or applicable in all manufacturing settings. One problem with this arrangement is that often times in the construction and fabrication of waveguides, it is often necessary to use different types of grit or sandblasting systems. One such other type of system is a grit or sandblasting system which requires a venturi effect to mix the air and grit together. That is, in many instances, only venturi type blasters are available wherein the mixture of grit and air requires a venturi effect to effect mixing. However the use of such a prior art nozzle design shown in FIG. 1 is prohibited in venturi type systems. That is, as seen in FIG. 1, a part of the nozzle 1 at location B is tapered in diameter to effect a constricted flow effect. A venturi effect pressure system has been found not to be functionally acceptable with nozzles as shown in FIG. 1 because of the constricted passage at the section B illustrated in FIG. 1. This constriction of the air flow illustrated by the arrowheaded lines, hinders the ability of the nozzle to draw grit from the supply and mix it with air and thus to ultimately accomplish the desired grit blasting effect.

Accordingly, it is an object of the present invention to provide a grit blast nozzle adapter for surface conditioning of an internal tube which is capable of being used either in a direct pressure or a venturi effect pressure grit blast system.

It is a further object of the invention to provide a grit blast nozzle adapter of the aforementioned type whereby the inner surface of a hollow tube is capable of being conditioned in a 360° conditioning arc.

Still a further object of the invention is to provide a grit blast nozzle adapter of the aforementioned type wherein registration of said nozzle adapter to the central axis of the tube is affected with repeatability and ease of placement.

Further objects and advantages of the invention will become apparent from the following disclosure and the appended claims.

SUMMARY OF THE INVENTION

The invention resides in a method of conditioning an inner surface of a tube comprising the steps of: providing a pressurized mixture of air and grit and supplying same through a conventional nozzle having an opening with a given diameter through which diameter the pressurized grit and air pass; providing an elongated nozzle adapter having a deflector at the free end thereof and connecting the nozzle adapter to the nozzle; providing the nozzle adapter with a passage having a diameter substantially equal to or slightly larger than the diameter of the opening in the nozzle and connecting the nozzle adapter to the nozzle such that the opening in the nozzle and the passage are aligned with one another; said grit and air passing from the conventional nozzle through the nozzle adapter of the present invention and inserting the nozzle adapter into a tube and axially moving and rotating same in order to condition the inner surface thereof with a pressurized mixture of air and grit; and maintaining sufficient force to properly condition the inner surface.

The invention further resides in a device for treating an inner surface of a tube comprising: a supply of pressurized mixture of air and grit and a conventional nozzle having an opening with a given diameter through which diameter the pressurized grit and air pass; an elongated nozzle adapter having a deflector at the free end thereof connected to the nozzle; the nozzle adapter having a passage having a diameter substantially equal to the diameter of the opening in the nozzle and means for connecting the nozzle adapter to the conventional nozzle such that the opening in the conventional nozzle and the passage in the nozzle adapter are aligned with one another; and wherein the nozzle adapter is inserted into a tube and axially moved and rotated in order to condition the inner surface thereof with a pressurized mixture of air and grit.

DETAILED DESCRIPTION OF THE PREFERRED EMBODIMENTS

Figure 1:
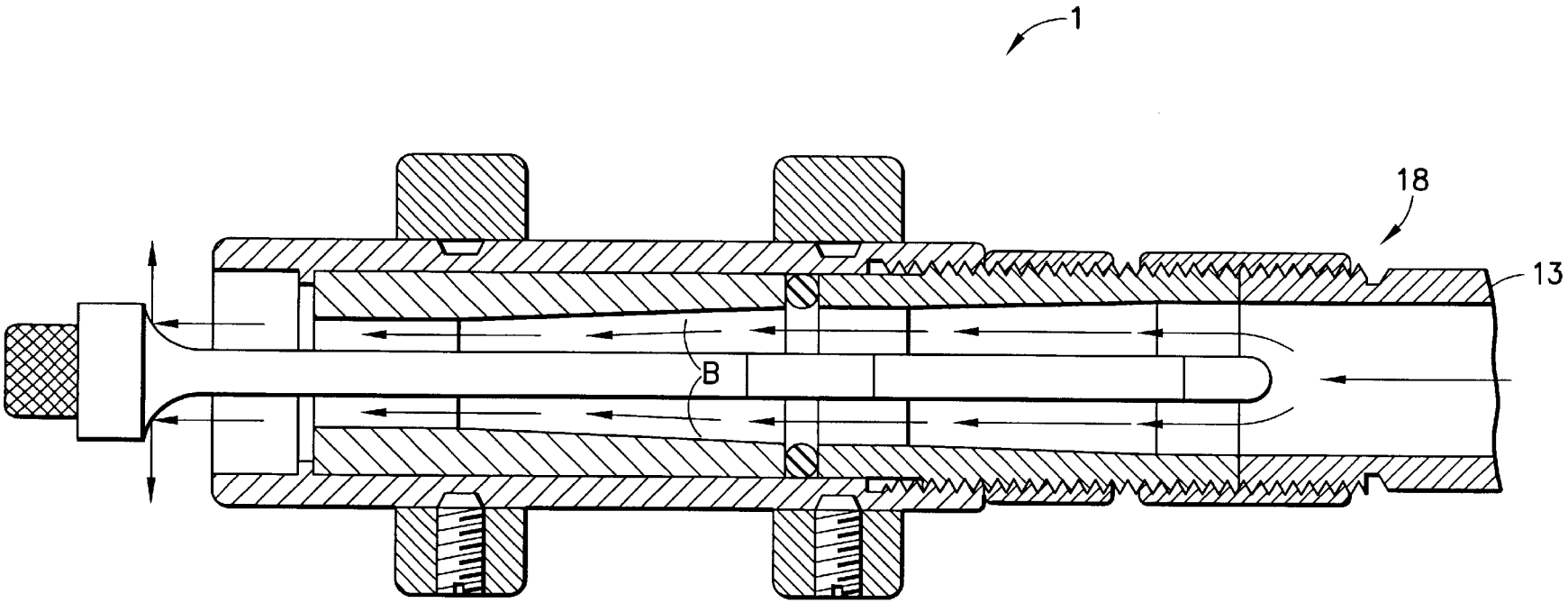
FIG. 1 PRIOR ART
FIG. 1 is a showing of a prior art direct pressure grit blast nozzle.
Figure 2:
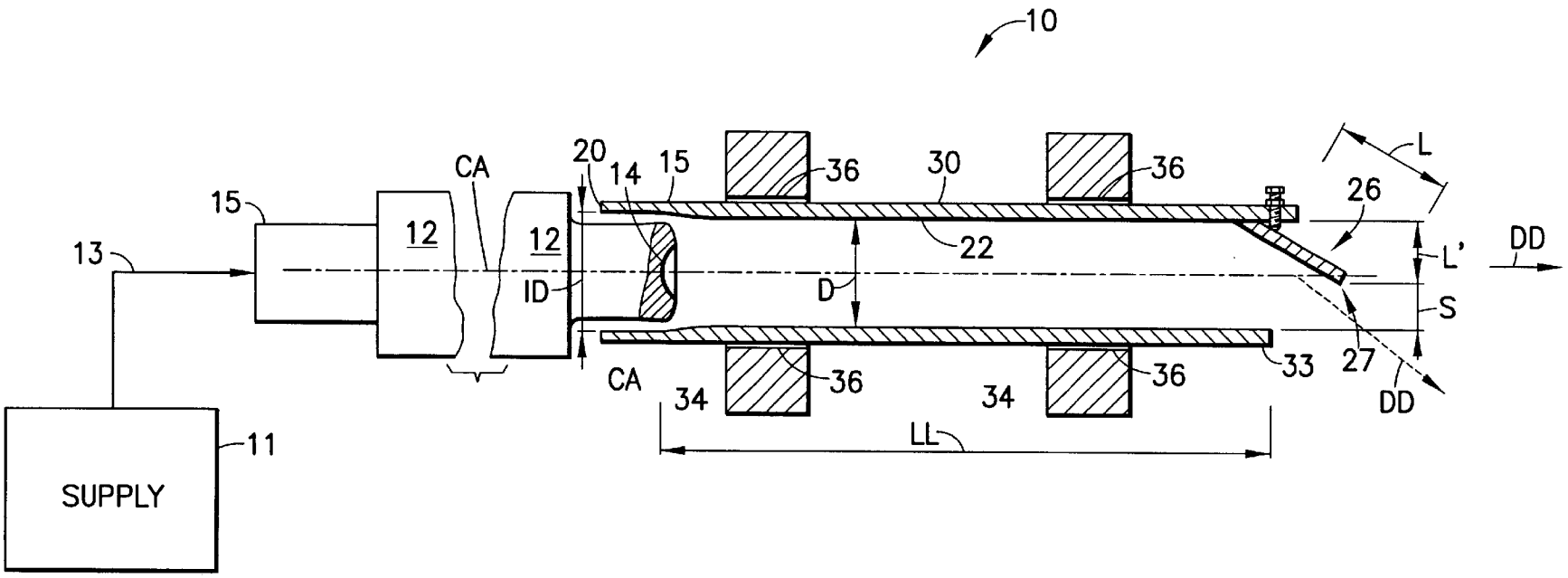
FIG. 2 is a side elevation view of the grit blast nozzle adapter of the present invention.

Referring now to FIG. 2 and the invention, it should be seen that the invention resides in a tool which employs a nozzle adapter indicated as 10 which is connectable to a conventional nozzle 12 of a grit blast system. The grit blast nozzle 12 is attached to a means 11 by which pressurized air and grit are provided so as to be expelled together through an opening 14 in the nozzle 12 in the indicated direction DD. The direction DD extends perpendicularly to the opening 14 in the nozzle 12 such that the grit is not redirected in a direction other than parallel to the direction DD through the opening 14. A standard supply line 13 is provided and is threaded to the nozzle 12 at one end 15 thereof in a manner similar to the one shown in FIG. 1 at connection 18 to fluidically connect the means 11 with the nozzle 12.

The means 11 by which the grit and pressurized air are mixed can be one that is conventionally known as a direct pressure system or a venturi pressure system for which the present invention adapter is capable of being used equally alternatively functionally.

The nozzle adapter 10 is comprised of a cylindrical hollow tube 30 having an internal conduit 22 therein, a deflector 26 located at and connected to the far end 33 of the tube 30, and two mounting blocks 34,34 which have journalling openings 36,36 for receiving therein the circular outer surface of the tube 30. The one end 15 of the tube 30 has a means 20 for connecting it over the nozzle 12. This means may take many different forms, but in the preferred embodiment it takes the form of an increased inner diameter ID taken relative to the remainder of the inner diameter D of the tube 30. The increased dimension of the inner diameter ID is provided such that the end 15 of the nozzle can be press fit over the nozzle end so as to fit snugly thereover. Alternatively, the end 15 may connect to the nozzle 12 using any other equivalent form, such as a screw thread, or over the center latches, but in any event, the connection is such that it does not interfere with the free flow of grit and air through the opening 14 in the nozzle and it is readily detachable therefrom. The tubular member 30 and the nozzle 12 are connected in this way such that each extends coextensively with the central axis CA of the nozzle adapter 10. The nozzle adapter 10 central axis CA is also parallel to the expulsion direction DD of the grit blast.

The tubular conduit 22 has an inner diameter D which is slightly larger in size than the diameter of the opening 14 in the nozzle 12. At the end 33 opposite from the nozzle end 12 of the tubular conduit 22 is the deflector 26 which is made of a hard material and which connects to the side of the tubular member 30 and is directed inwardly toward the central axis CA. The deflector has a length L such that the projected length, L; is shorter than the diameter D of tubular conduit 22 so as not to cause significant depressurization in the air flow passing through the tubular conduit 22 and impinging on the deflector. Thus a clearance S is provided between the deflector tip 27 and the inner surface of the conduit 22 to effect a flow passage as illustrated by the line DD. The tubular member 30 has a length LL of between 4–12 inches in the preferred embodiments, but could be longer or shorter as required.

Disposed about the tubular member 30 is a pair of locating blocks 34,34 each of which has a journaling opening 36,36 coaligned with one another and sized to receive the outer diameter of the tubular member 30. The journaling blocks and the outside surface of the tubular member 30 may be provided with a corresponding annular retaining ring/groove arrangement which enables the two blocks to be rotated relative to one another yet be axially maintained positionally relative to one another on the member 30. The blocks 34,34 can be made from many different types of materials, but in the preferred embodiments each is made from plastic. The locating blocks, 34,34 are optional; the nozzle can be used with or without them.

Figure 3:
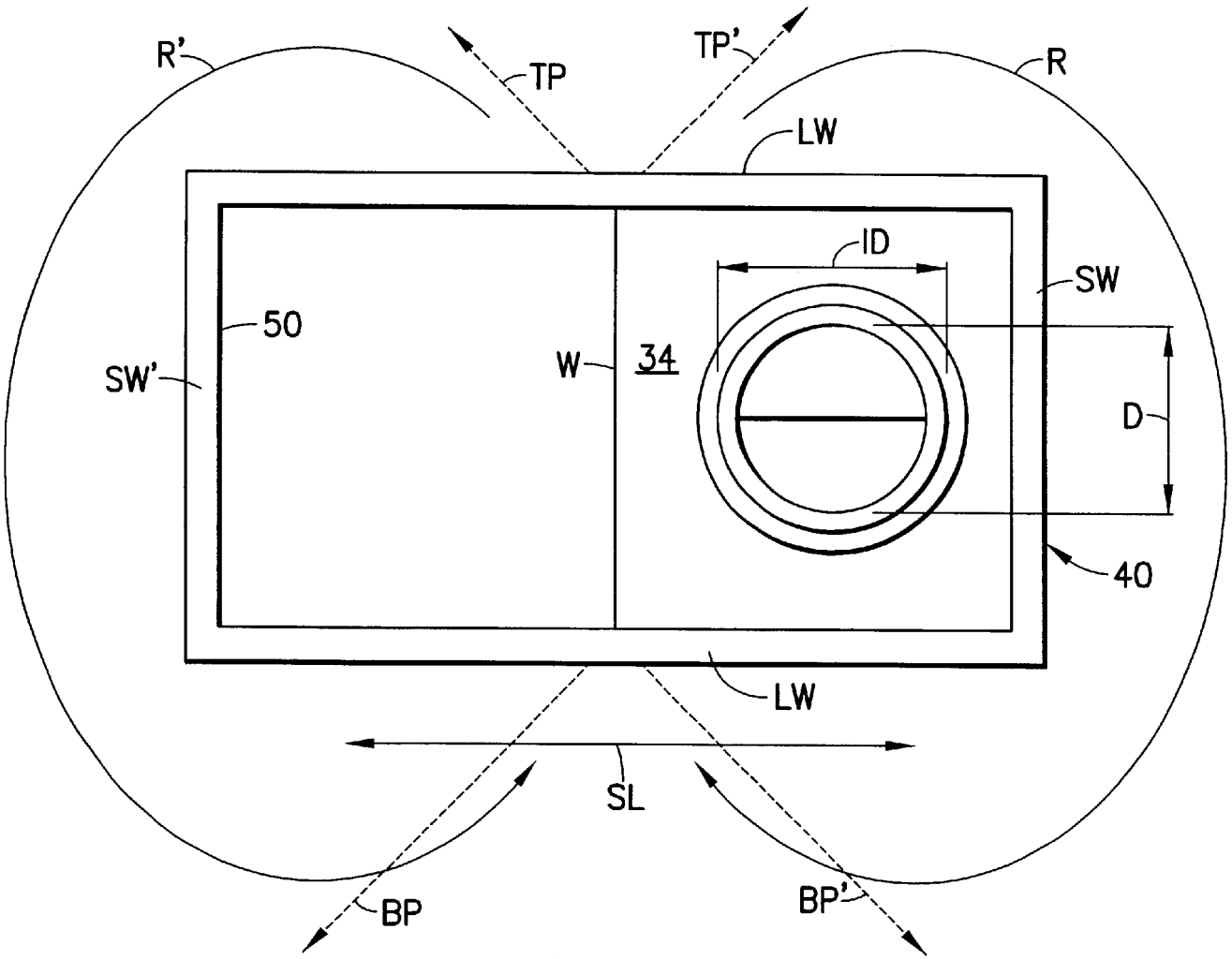
FIG. 3 is an end view of a waveguide tube showing the grit blast nozzle adapter located in one half of its cross-section.

Referring now to FIG. 3, it should be seen that the waveguide or any tubular member illustrated as 40 has a generally rectangular cross section with side walls SW and long walls LW together creating a rectangular shape. The locating blocks 34,34 are square or rectangular in shape in the preferred embodiments and are sized such that the length of each wall W of the locating block is one half the length of the long wall LW and slightly smaller than SW of the waveguide if square, and slightly smaller than the walls SW and LW if rectangular. In this way, by sliding the square locating block laterally along the long wall LW (along line SL), the inner surface of the tubular waveguide 40 can be conditioned. That is, in order to treat about one half of the inner surfaces of the waveguide, the locating block is moved in abutment with one side wall SW of the waveguide 40 associated with that wall and then is rotated to condition the associated inner surface. The locating blocks could be circular or any shape to fit the shape of the tubular member to be conditioned.

More specifically, by rotating the tubular member 30 through an arc in the direction R with the deflector 26 pointed initially at TP and then after rotation pointing at BP, the right half of the inner surfaces 50 of the waveguide tube 40 are conditioned by the grit blast. In order to condition the other one-half of the inner surfaces of the waveguide tube 40, the locating block is slid laterally along the length of the wall LW to a point where it abuts the opposite sidewall SW' of the waveguide tube 40, and the operation is repeated. By rotating the tubular member 30 through an arc in the direction R' with the deflector 26 pointed initially at TP' and then after rotation pointing at BP', the left half of the inner surfaces 50 of the waveguide tube 40 are conditioned by the grit blast. In this way all the inner surfaces 50 of the waveguide tube 40 are conditioned. When using a rectangular locating block, once one half of the waveguide tube is conditioned as described above, the nozzle adapter and locating blocks are removed from the waveguide tube and reinserted into the waveguide tube with the nozzle adapter in the opposite (unconditioned) half of the waveguide tube and this half is treated in the same manner as described above. In this way, the interior surfaces of the waveguide tube 40 are conditioned by directing the grit blast essentially perpendicular to the surfaces 50 that are being conditioned. This allows the subsequent metal coating to be made in a repeatable uniform manner and also provides for uniform and repeatable adhesion of the metal coating to the inner surface. The nozzle adapter can be simultaneously rotated and moved axially along the length of the waveguide tube 40 in order to cover all the inner surface of the waveguide.

By the foregoing, an improved method and apparatus of treating a surface of the waveguide has been disposed in the preferred embodiment. However, numerous modifications and substitutions may be made without departing from the spirit of the invention. In particular, it should be seen that while two locating blocks have been disclosed in the preferred embodiment, it is also possible that a single such block may be used to affect registration of the adapter within the waveguide tube. Also, the tubular member 30 can be varied such that the inner diameter ID of the tubular member 30 can in fact be made equal to the opening diameter 14 if a means for connecting the tubular conduit 22 to the nozzle 12 is used such as to allow it to be butted up to the end surface of the nozzle. Also, the shape of the conditioned tube, 40, can be any shape with adaptations to the locating blocks. Accordingly, the application has been described by way of illustration rather than limitation. While the present invention has been particularly described with respect to a preferred sequence of process steps in its preferred method and certain elements in its preferred embodiment, it will be understood that the invention is not limited to these particular methods and apparatus described in the preferred embodiments, the process steps, the sequence, or the final structures depicted in the drawings. On the contrary, it is intended to cover all alternatives, modifications, and equivalents as may be included within the scope of the invention defined by the appended claims. In particular, the scope of the invention is intended to include, for example, those devices and methods for conditioning any suitable tube, piping or structure. In addition, other methods and devices may be employed in the method and apparatus of the instant invention as claimed with similar results.

What is claimed is:

1. A method of conditioning an inner surface of a hollow tube comprising the steps of:

providing a pressurized mixture of air and grit and supplying same to a nozzle having an opening with a given diameter through which diameter the pressurized grit and air pass;

providing an elongated nozzle adapter having a deflector at the far end thereof and connecting said nozzle adapter to said nozzle;

providing said nozzle adapter with a passage having a diameter substantially equal to the diameter of said nozzle and connecting said nozzle adapter to said nozzle such that the opening in said nozzle and said passage are aligned with one another;

inserting said nozzle adapter into a hollow tube and axially moving and rotating same in order to condition the inner surface thereof with a pressurized mixture of air and grit;

providing said nozzle adapter with a means for attaching same to said nozzle and releasably attaching said nozzle adapter and said nozzle to one another;

providing at least one locating block and a journalling opening in said locating block and placing said nozzle adapter through said journalling opening and rotating same in an arc to cover at least half the inner surface of said hollow tube;

providing said locating block with a shape corresponding to said tube being conditioned; and providing said hollow tube having a rectangular cross section taken from end view and providing said at least one locating block as a square rectangular shape such that the side dimension of said square locating block is equal to one half the width of said rectangular shaped hollow tube.

2. A method as defined in claim 1 further characterized by positioning of at least one square locating block in one half of the hollow portion of said rectangular tube such that one side wall of said locating block is placed in confrontation with a short side of the rectangularly shaped hollow tube and rotating said nozzle adapter from one point to a second point internal to the hollow tube.

3. A method as defined in claim 2 further characterized by sliding said at least one locating block from said position confronting one short side face of said rectangular tube to the opposite short side face thereof and rotating said nozzle adapter to complete conditioning of the remaining unconditioned surface of said hollow tubular member.

4. A method as defined in claim 3 further characterized by sliding said nozzle adapter relative to the length of said tube and rotating same to effect surface conditioning.

5. A method as defined in claim 4 further characterized by providing a second locating block and a journalling opening therethrough for receiving said nozzle adapter therein; and spacing said first and second locating blocks axially along said nozzle adapter to support the nozzle adapter in a beam like manner.

6. A method as defined in claim 5 further characterized by providing said passage in said nozzle adapter with an end opening and said deflector at said far end and using said deflector for directing a grit blast by disposing said deflector at an angle outwardly toward the inner surface of said tube.

7. A method as defined in claim 6 further characterized by providing said deflector with an effective projected length which is not greater than the inner diameter of said passage.

8. A device for conditioning an inner surface of a hollow tube comprising:

a supply of pressurized mixture of air and grit and a nozzle having an opening with a given diameter through which diameter the pressurized grit and air pass;

an elongated nozzle adapter having a deflector at the far end thereof connected to said nozzle;

said nozzle adapter having a passage having a diameter substantially equal to the diameter of said opening in said nozzle and means for connecting said nozzle adapter to said nozzle such that the opening in said nozzle and said passage are aligned with one another;

wherein said nozzle adapter is inserted into a tube and axially moved and rotated in order to condition the inner surface thereof with a pressurized mixture of air and grit;

wherein said means for connecting said nozzle and nozzle adapter together includes a releasably attaching connection;

said nozzle adapter having least one locating block and a journalling opening in said locating block and locating said tubular member through said journalling opening and rotating same in an arc to cover at least half the inner surface of said hollow tube; and said tube to be conditioned having a rectangular cross section taken from end view and said at least one locating block having a square rectangular shape such that the side dimension of said square locating block is equal to one-half the width of said rectangular shaped hollow tube.

9. A device as defined in claim 8 further characterized by dimensioning said locating block such that said at least one square locating block is positioned in one-half of the hollow cross-sectional area of said rectangular tube such that one side wall of said locating block is placed in confrontation with a short side of the rectangularly shaped hollow tube and said nozzle adapter is adapted to rotate from one point to a second point internal to the hollow tube.

10. A device as defined in claim 9 wherein said at least one locating block is adapted to slide from said position confronting one short side face of said rectangular tube to the opposite short side face thereof and said nozzle adapter is adapted to rotate to complete conditioning of the remaining unconditioned surface of said hollow tubular member after it is slid to said opposite short side face.

11. A device as defined in claim 8 further characterized by said nozzle adapter being adapted to slide relative to the length of said tube and being adapted to rotate to effect surface conditioning.

12. A device as defined in claim 11 further characterized by a second locating block, a journalling opening therethrough for receiving said nozzle adapter therein; and said first and second locating blocks being spaced axially along said nozzle adapter to support the nozzle adapter in a beam like manner.

13. A device as defined in claim 8, further characterized in that said locating block has a shape corresponding to said tube being conditioned.

14. A method of conditioning an inner surface of a hollow tube comprising the steps of:

providing a pressurized mixture of air and grit and supplying same to a nozzle having an opening with a given diameter through which opening the pressurized grit and air pass;

providing an elongated nozzle adapter having a deflector at the far end thereof and connecting said nozzle adapter to said nozzle;

inserting said nozzle adapter into a tube in a direction generally parallel to a longitudinal axis of said tube and offset from said axis toward one side of the tube and axially moving and rotating through an arc in order to condition a first portion of the inner surface of the tube with the pressurized mixture of air and grit; and moving said nozzle adapter transversely of said tube toward an opposing side of the tube and axially moving and rotating through a different arc following said transverse movement in order to condition a remaining portion of the inner surface thereof with the pressurized mixture of air and grit.

15. A method as defined in claim 14 further characterized by said tube comprising a wave guide member having a rectangular cross-section.

16. A method defined in claim 15, further characterized by supporting said nozzle adapter for said axial and rotating movement and for sliding movement transversely of said tube.

17. A method defined in claim 15, wherein for conditioning the first portion of the inner surface of the tube the nozzle adapter is rotated through a first arc and wherein for conditioning the remaining portion of the inner surface of the tube the nozzle adapter is rotated through a second arc different from said first arc.

* * * * *

UNITED STATES PATENT AND TRADEMARK OFFICE

CERTIFICATE OF CORRECTION

PATENT NO. : 6,350,185 B1
DATED : February 26, 2002
INVENTOR(S) : Robins et al.

It is certified that error appears in the above-identified patent and that said Letters Patent is hereby corrected as shown below:

Column 7,
Line 17, insert -- the nozzle adapter -- after "rotating"

Column 8,
Line 1, insert -- the nozzle adapter -- after "rotating"

Signed and Sealed this

Fourteenth Day of May, 2002

*Attest:*

*Attesting Officer*

JAMES E. ROGAN
*Director of the United States Patent and Trademark Office*